US009201392B2

(12) United States Patent
Uneme

(10) Patent No.: US 9,201,392 B2
(45) Date of Patent: Dec. 1, 2015

(54) CARTRIDGE AND METHOD OF MANUFACTURING CARTRIDGE

(71) Applicant: CANON KABUSHIKI KAISHA, Tokyo (JP)

(72) Inventor: Tetsushi Uneme, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/100,407

(22) Filed: Dec. 9, 2013

(65) Prior Publication Data

US 2014/0161484 A1 Jun. 12, 2014

(30) Foreign Application Priority Data

Dec. 10, 2012 (JP) ..... 2012-269557

(51) Int. Cl.
*G03G 21/16* (2006.01)
*G03G 21/18* (2006.01)
*G03G 15/08* (2006.01)

(52) U.S. Cl.
CPC ..... *G03G 21/181* (2013.01); *G03G 15/0865* (2013.01); *G03G 15/0875* (2013.01); *G03G 21/1821* (2013.01); *Y10T 29/49826* (2015.01)

(58) Field of Classification Search
CPC ..... G03G 21/1652; G03G 21/1647; G03G 21/1814; G03G 2221/166; G03G 21/1633; G03G 21/1676; G03G 21/18; G03G 21/1807; G03G 2221/1657; G03G 2221/1684; G03G 2215/2035; G03G 15/0865; G03G 15/2053
See application file for complete search history.

(56) References Cited

U.S. PATENT DOCUMENTS

| | | | | |
|---|---|---|---|---|
| 5,940,657 | A * | 8/1999 | Yokomori et al. | 399/119 |
| 2004/0091282 | A1* | 5/2004 | Yokoi | 399/109 |
| 2011/0229196 | A1* | 9/2011 | Kawai et al. | 399/111 |

FOREIGN PATENT DOCUMENTS

| | | | |
|---|---|---|---|
| JP | 2003-241619 | A | 8/2003 |
| JP | 2010-026500 | A | 2/2010 |
| JP | 2010-224363 | A | 10/2010 |

* cited by examiner

*Primary Examiner* — Roy Y Yi
(74) *Attorney, Agent, or Firm* — Canon USA, Inc., IP Division

(57) ABSTRACT

A method of manufacturing a cartridge including a first member having a flexible engaging portion and a second member having an engaged portion to be engaged with the engaging portion, configured to manufacture a cartridge by a process of engaging the engaging portion of the first member and the engaged portion of the second member; and a process of forming a third member configured to restrict a movement of the flexible engaging portion by letting a fluent material flow in between the first member and the second member and solidifying the fluent material.

12 Claims, 12 Drawing Sheets

CARTRIDGE AND METHOD OF MANUFACTURING CARTRIDGE

BACKGROUND OF THE INVENTION

1. Field of the Invention

This disclosure relates to a cartridge configured to be demountably mounted to an electrophotographic image forming apparatus (hereinafter, referred to as "image forming apparatus").

The image forming apparatus is configured to form an image on a recording medium by using an electrophotographic system. Examples of the image forming apparatus include copying machines, printers (for example, laser beam printers, and LED printers), facsimile apparatuses, and word processors.

The cartridge relates to a developing cartridge which is an integral cartridge including a developing device used for developing an electrostatic latent image on an electrophotographic photosensitive member and a process cartridge which is an integral cartridge including at least one of a charging device, a developing device, and a cleaning device which correspond to process devices and an electrophotographic photosensitive member which corresponds to an image bearing member (hereinafter, referred to as "photosensitive drum"). The developing cartridge and the process cartridge are demountably mounted on the image forming apparatus.

2. Description of the Related Art

An image forming apparatus is configured to charge a photosensitive drum which corresponds to an image bearing member uniformly and form a latent image by selective exposure of the photosensitive drum to light. The latent image is developed by a developing agent (hereinafter, referred to as "toner"), and is visualized as a toner image. Then, the toner image is transferred to a recording medium.

The toner image is fixed to the recording medium by applying the transferred toner image with heat or pressure, whereby the image is recorded. In the related art, the image forming apparatus in this configuration is subjected to a toner supply or maintenance of various process devices.

As devices to facilitate the toner supply work or the maintenance, a cartridge system in which all or part of the devices such as the photosensitive drum, a charging device, a developing device, and a cleaning device are collectively unified into a cartridge so as to be demountably mountable on the image forming apparatus is employed.

According to the cartridge system described above, the maintenance of the apparatus can be performed by a user by his or her own in a form of replacement of cartridge, and hence operability may dramatically be improved. Therefore, the cartridge system is widely employed in the image forming apparatuses.

The cartridge as described above includes a plurality of members. Examples of known method of fixing the plurality of members in the related art include fixation with screws and fixation with ultrasonic wave welding. As a simplified method, a method of fixing a flexible first engaging portion provided on a first member in a state of being assembled to a second member is known (see Japanese Patent Laid-Open No. 2010-26500). Specifically, the first engaging portion is restricted from being bent by mounting a restriction portion provided on a third member in a state in which the first engaging portion is assembled to the second member in a state of being bent. Accordingly, the first member and the second member are assembled.

In the related art, in order to maintain the state in which the first member and the second member are assembled, a configuration for fixing the third member having the restriction portion which restricts the flexible first engaging portion from being bent is additionally required.

However, when the third member is mounted for restricting the first engaging portion from being bent, rattling may easily result between the first and second members and the third member as the restriction portion due to variations in dimension due to tolerances. In particular, the rattling becomes an issue for positioning of members which require positional accuracy such as that between a developing roller and a developing blade as developing devices or between the photosensitive drum and a cleaning blade as a cleaning device when a flame member and a bearing are fixed.

Accordingly, this disclosure provides a cartridge with little rattling even though there are variations in dimension due to the tolerances with a fixing method using a flexible engaging portion instead of fixation on the basis of screws or ultrasonic welding. Consequently, a cartridge stable in positional accuracy such as that between the developing roller and the developing blade or between the photosensitive drum and the cleaning blade is also provided.

SUMMARY OF THE INVENTION

A first aspect of this disclosure is a method of manufacturing a cartridge including a first member having a flexible engaging portion and a second member having an engaged portion to engage with the engaging portion, including: engaging the engaging portion of the first member and the engaged portion of the second member; and forming a third member configured to restrict a movement of the flexible engaging portion by flowing a fusing resin in between the first member and the second member and solidifying the fusing resin.

A second aspect of this disclosure provides a cartridge including: a first member having a flexible engaging portion; a second member having an engaged portion to be engaged with the engaging portion; and a third member configured to restrict a movement of the flexible engaging portion for maintaining a state in which the engaging portion and the engaged portion engage each other; wherein a width of the third member on the side closer to a base point of movement of the flexible engaging portion becomes larger than the width of the third member on the side farther from the base point of movement.

A third aspect of this disclosure is a cartridge including: a first member having a flexible engaging portion; a second member having an engaged portion to be engaged with the engaging portion; and a third member configured to restrict a movement of the flexible engaging portion for maintaining a state in which the engaging portion and the engaged portion engage each other; wherein a width of the third member on a side closer to a base point of movement of the flexible engaging portion becomes larger than a width of the third member on a side farther from the base point of movement, wherein the third member includes a holding portion configured to hold the third member at a position capable of restricting the movement of the flexible engaging portion, and at least one of the first member and the second member includes a held portion to be engaged with the holding portion.

Further features of the present invention will become apparent from the following description of exemplary embodiments with reference to the attached drawings.

DESCRIPTION OF THE EMBODIMENTS

Example 1

Referring now to FIG. 1A to FIG. 10B, examples of this disclosure will be described.

In the following embodiments, a full color laser printer in which four process cartridges including a developing apparatus are demountably mounted is exemplified as an image forming apparatus.

However, this disclosure is not limited to the printer, and may be applied to other image forming apparatuses such as copying machines and facsimile apparatuses, or other image forming apparatuses such as combined machines in which such functions are combined.

The number of process cartridges to be mounted on the image forming apparatus is not limited to four. The number of process cartridges may be set as needed.

For example, in a case of an image forming apparatus forming monochrome images, the number of the process cartridges to be mounted on the image forming apparatus is one.

In Example 1, a process cartridge including a developing apparatus will be described. However, other configurations may be applied in implementation of this disclosure. For example, a configuration in which the cartridges (or the developing apparatuses) are demountably mounted on the image forming apparatus or a configuration in which the cartridges are integrated into the image forming apparatus and cannot be mounted and demounted is also applicable.

Schematic Configuration of Image Forming Apparatus

Figure 2:
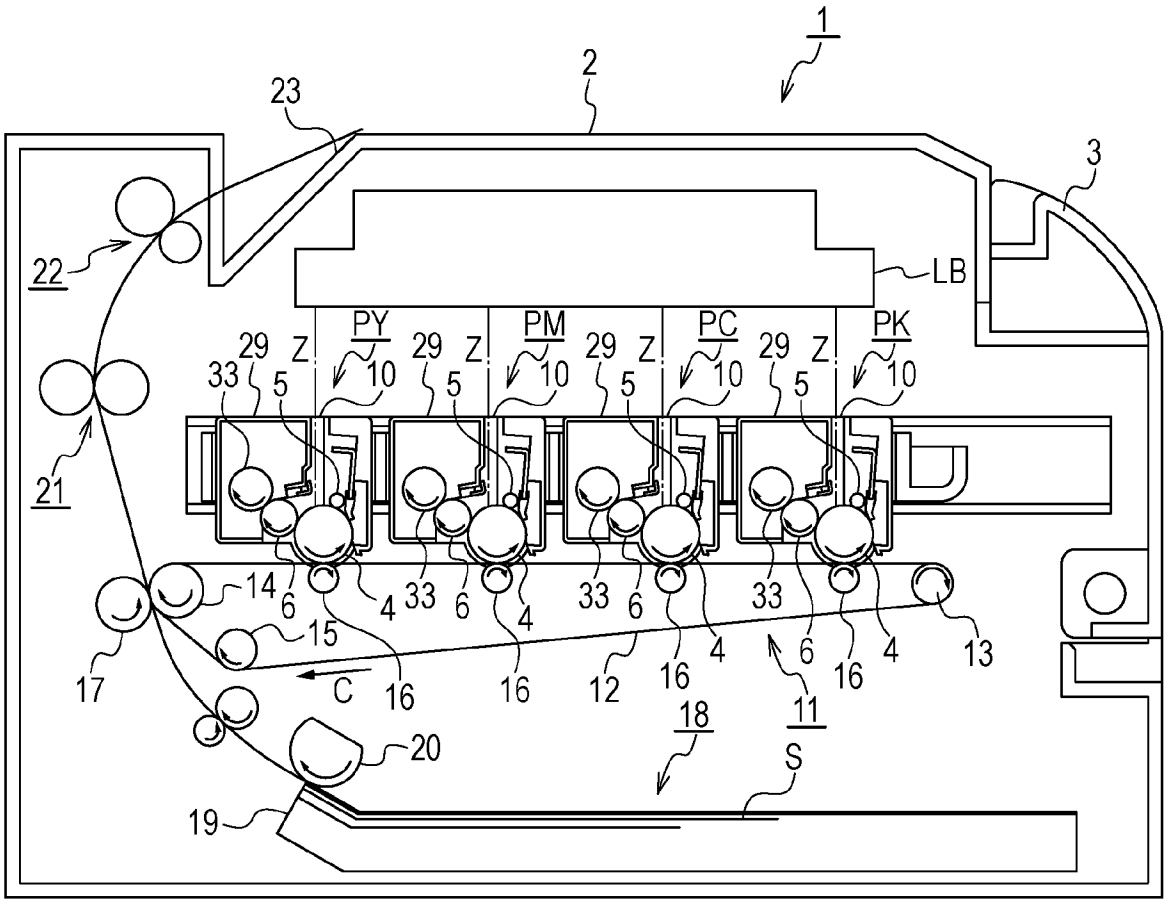
FIG. 2 is a schematic cross sectional view illustrating an example of an electrophotographic image forming apparatus of this disclosure.

First of all, a schematic cross-sectional view of the image forming apparatus of Example 1 will be illustrated in FIG. 2.

An image forming apparatus 1 is a full color laser printer with four colors using an electrophotographic process, and forms a color image on a recording medium S. The image forming apparatus 1 employs a process cartridge system, and is configured to allow demountably mounting of a process cartridge (hereinafter, referred to as "cartridge") on and from a main body 2 of the apparatus to form a color image on the recording medium S.

Here, a side of the image forming apparatus 1 where an apparatus opening-and-closing door 3 is provided is defined as a front (front surface), and a surface opposite to the front surface is defined as a back surface (rear surface). The right side of the image forming apparatus 1 when viewing the image forming apparatus 1 from the front is referred to as "drive side", and the left side is referred to as "nondrive side".

The main body 2 of the apparatus includes four cartridges P (PY, PM, PC, and PK) including a first cartridge PY, a second cartridge PM, a third cartridge PC, and a fourth cartridge PK arranged in the horizontal direction.

The first to fourth cartridges P (PY, PM, PC, and PK) have the same electrophotographic process mechanisms, and contain toners in different colors. A rotational drive force is transmitted from a drive output unit (not illustrated) of the main body 2 of the apparatus to the first to fourth cartridges P (PY, PM, PC, and PK).

A bias voltage (charging bias, developing bias, for example) is supplied from the main body 2 of the apparatus to each of the first to fourth cartridges P (PY, PM, PC, and PK) (not illustrated).

Figure 3:
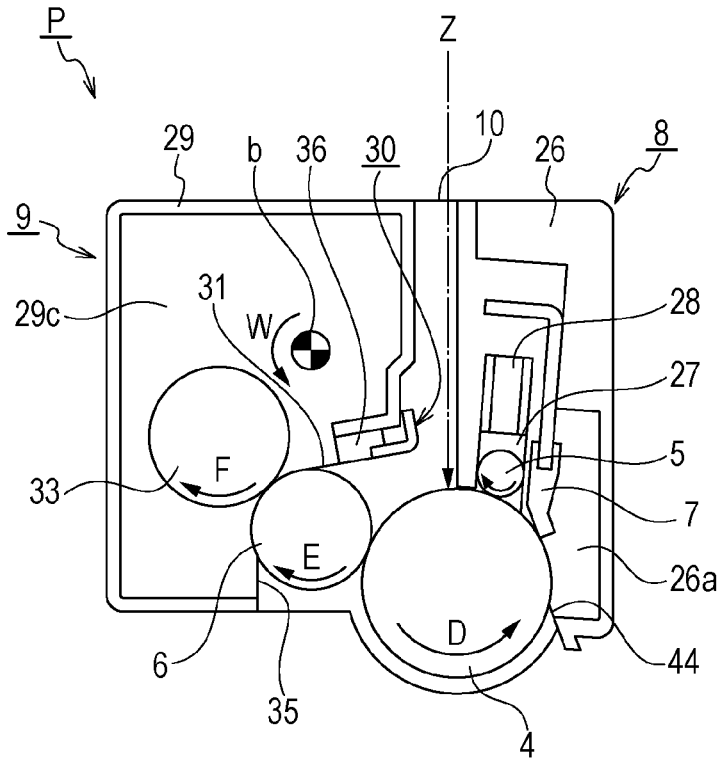
FIG. 3 is a cross-sectional view illustrating an example of a process cartridge of this disclosure.

As illustrated in FIG. 3, the first to fourth cartridges P (PY, PM, PC, and PK) of Example 1 each include a cleaning unit 8 including a charging device and a cleaning device which correspond to process devices acting on a photosensitive drum 4 which corresponds to the image bearing member.

The first to fourth cartridges P (PY, PM, PC, and PK) each include a developing apparatus 9 having a developing device configured to develop an electrostatic latent image on the photosensitive drum 4 which corresponds to an image bearing member.

The cleaning unit 8 and the developing apparatus 9 are coupled to each other. A charge roller 5 is used as the charging device, a cleaning blade 7 is used as the cleaning device, and a developing roller 6 which corresponds to a developer bearing member is used as the developer bearing member. Further detailed configuration of the cartridge will be described later.

As illustrated in FIG. 2, the first cartridge PY accommodates yellow (Y) tonner in a developing frame 29, and forms a yellow toner image on a surface of the photosensitive drum 4 which corresponds to the image bearing member.

The second cartridge PM accommodates magenta (M) toner in the developing frame 29, and forms a magenta toner image on the surface of the photosensitive drum 4 which corresponds to the image bearing member.

The third cartridge PC accommodates cyan (C) toner in the developing frame 29, and forms a cyan toner image on the surface of the photosensitive drum 4 which corresponds to the image baring member.

The fourth cartridge PK accommodates black (K) toner in the developing frame 29, and forms a black toner image on the surface of the photosensitive drum 4 which corresponds to the image bearing member.

A laser scanner unit LB, which corresponds to an exposure device, is provided above the first to fourth cartridges P (PY, PM, PC, and PK). The laser scanner unit LB outputs a laser beams Z corresponding to image information. The surfaces of the photosensitive drums 4 are scanned and exposed by the laser beam Z passing through exposure window portions 10 of the cartridges P.

An intermediate transfer belt unit 11, which corresponds to a transfer member, is provided below the first to fourth cartridges P (PY, PM, PC, and PK). The intermediate transfer belt unit 11 includes a drive roller 13, a turn roller 14, and a tension roller 15, and a flexible transfer belt 12 is extended around these rollers.

Lower surfaces of the photosensitive drums 4 including the first to fourth cartridges P (PY, PM, PC, and PK) are in contact with an upper surface of the transfer belt 12. Contact portions therebetween correspond to primary transfer portions. Primary transfer rollers 16 are provided so as to oppose the photosensitive drums 4 on the inner side of the transfer belt 12.

A second transfer roller 17 abuts against the turn roller 14 via the transfer belt 12. A contact portion between the transfer belt 12 and the second transfer roller 17 corresponds to a second transfer portion.

A feeding unit 18 is provided below the intermediate transfer belt unit 11. The feeding unit 18 includes a feed tray 19 which accommodates the recording media S in stack and a paper feed roller 20.

A fixing unit 21 and a discharge unit 22 are provided at upper left portions in the main body 2 of the apparatus in FIG. 2. An upper surface of the main body 2 of the apparatus is formed with a discharge tray 23.

A toner image is fixed to the recording medium S by a fixing device provided in the fixing unit 21 and is discharged to the discharge tray 23.

Image Forming Operation

An operation for forming a full color image is as follows.

The photosensitive drums 4 including the first to fourth cartridges P (PY, PM, PC, and PK) are driven to rotate at a predetermined speed (counterclockwise in FIG. 2, a direction indicated by an arrow D in FIG. 3).

As illustrated in FIG. 2, the transfer belt 12 is also driven to rotate at a speed corresponding to the speed of the photosensitive drums 4 in the normal direction (direction indicated by an arrow C) with respect to the rotation of the photosensitive drums 4.

The laser scanner unit LB is then driven. The charge rollers 5 charge the surfaces of the photosensitive drums 4 uniformly at a predetermined pole and potential in the respective cartridges synchronously with the driving of the laser scanner unit LB. The laser scanner unit LB scans and exposes the surfaces of the photosensitive drums 4 with the laser beams Z according to image signals of respective colors.

Accordingly, electrostatic latent images according to the image signals of corresponding colors on the surfaces of the respective photosensitive drums 4 are formed. The formed electrostatic latent images are developed by the developing rollers 6 which correspond to the developer bearing members driven to rotate (counterclockwise in FIG. 2, a direction indicated by an arrow E in FIG. 3) at a predetermined speed.

With the electrophotographic image forming process operation as described above, a yellow toner image corresponding to a yellow component of a full color image is formed on the photosensitive drum 4 of the first cartridge PY. Then, the corresponding toner image is primarily transferred onto the transfer belt 12.

In the same manner, a magenta toner image corresponding to a magenta component of the full color image is formed on the photosensitive drum 4 of the second cartridge PM. Then, the corresponding toner image is superimposed on and primarily transferred to the yellow toner image which is already transferred onto the transfer belt 12.

In the same manner, a cyan toner image corresponding to a cyan component of the full color image is formed on the photosensitive drum 4 of the third cartridge PC. Then, the corresponding toner image is superimposed on and primarily transferred to the yellow and magenta toner images which are already transferred onto the transfer belt 12.

In the same manner, a black toner image corresponding to a black component of the full color image is formed on the photosensitive drum 4 of the fourth cartridge PK. Then, the corresponding toner image is superimposed on and primarily transferred to the yellow, magenta, and cyan toner images which are already transferred onto the transfer belt 12.

In this manner, a four full color unfixed toner image of yellow, magenta, cyan, and black is formed on the transfer belt 12.

In contrast, the recording media S are fed one by one separately at predetermined control timing. The recording media S are introduced into the secondary transfer portion, which is an abutting portion between the second transfer roller 17 and the transfer belt 12 at predetermined control timing.

Accordingly, in the course of conveyance of the recording media S to the secondary transfer portion, the four color superimposed toner image on the transfer belt 12 is transferred at once to the surfaces of the recording media S in sequence.

Configuration of Cartridge

Figure 4:
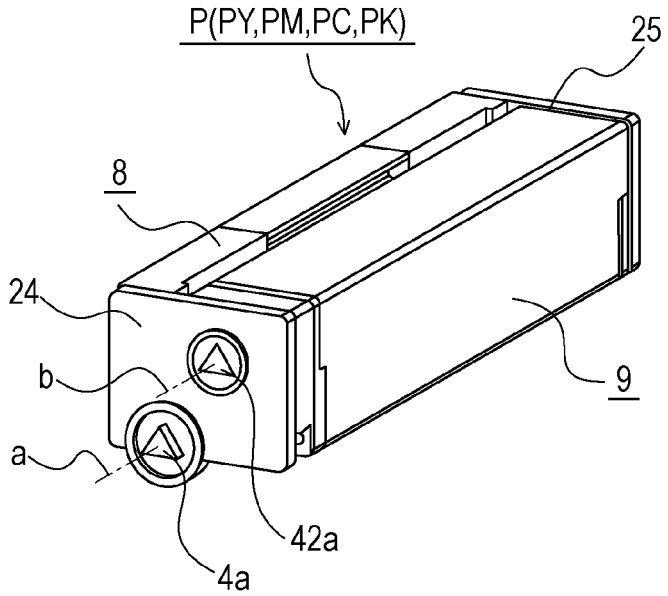
FIG. 4 is a perspective view illustrating an example of the process cartridge of this disclosure.

FIG. 4 is a perspective view illustrating an example of the cartridge of this disclosure and FIG. 3 is a cross-sectional view illustrating the example of the cartridge of this disclosure.

As illustrated in FIG. 4, the cartridges P (PY, PM, PC, and PK) each include the cleaning unit 8, the developing apparatus 9, a drive-side cover member 24, and a nondrive-side cover member 25.

As illustrated in FIG. 3, the cleaning unit 8 is composed of a cleaner case 26 having the photosensitive drum 4, the charge roller 5, and the cleaning blade 7.

As illustrated in FIG. 4, the photosensitive drum 4 is rotatably supported by the drive-side cover member 24 and the nondrive-side cover member 25, and is driven to rotate by receiving a drive force of a motor (not illustrated) of the main body 2 of the apparatus from a drum drive coupling 4*a* (in the direction indicated by the arrow D in FIG. 3).

As illustrated in FIG. 3, the charge roller 5 is rotatably supported at both ends thereof by a charge roller bearing 27 of the cleaner case 26, is driven to rotate in contact with the surface of the photosensitive drum 4, and charges the surface of the photosensitive drum 4 by receiving a supply of a charging bias. At this time, in order to charge the surface uniformly, the both end portions of the charge roller 5 are pressurized against the surface of the photosensitive drum 4 by a charge roller pressurizing spring 28.

The cleaning blade 7 is fixed to the cleaner case 26, and includes a resilient rubber portion at a distal end thereof so as to abut against the photosensitive drum 4 in a direction opposite to the direction of rotation of the photosensitive drum 4 (the direction indicated by the arrow D in FIG. 3). At the time of forming an image, untransferred toner remaining on the photosensitive drum 4 is scraped off to clean the surface of the photosensitive drum 4. At this time, the distal end of the cleaning blade 7 is in abutment with the surface of the photosensitive drum 4 at a predetermined pressure in order to scrape the untransferred toner completely.

The untransferred toner scraped off the surface of the photosensitive drum 4 by the cleaning blade 7 is accommodated in a waste toner accommodating portion 26*a* of the cleaner case 26 as waste toner. Therefore, a waste toner collection sheet member 44 for preventing leakage of the waste toner from a gap with respect to the photosensitive drum 4 and the cleaning blade 7 is fixed to the cleaner case 26 in the longitudinal direction of the photosensitive drum 4. Cleaning blade end sealing members (not illustrated) are provided at both ends of the cleaning blade 7 in the longitudinal direction.

Mounting and Demounting Configuration of Cartridge

Subsequently, mounting and demounting operations of the cartridges P (PY, PM, PC, and PK) to the main body 2 of the apparatus will be described.

Figure 5:
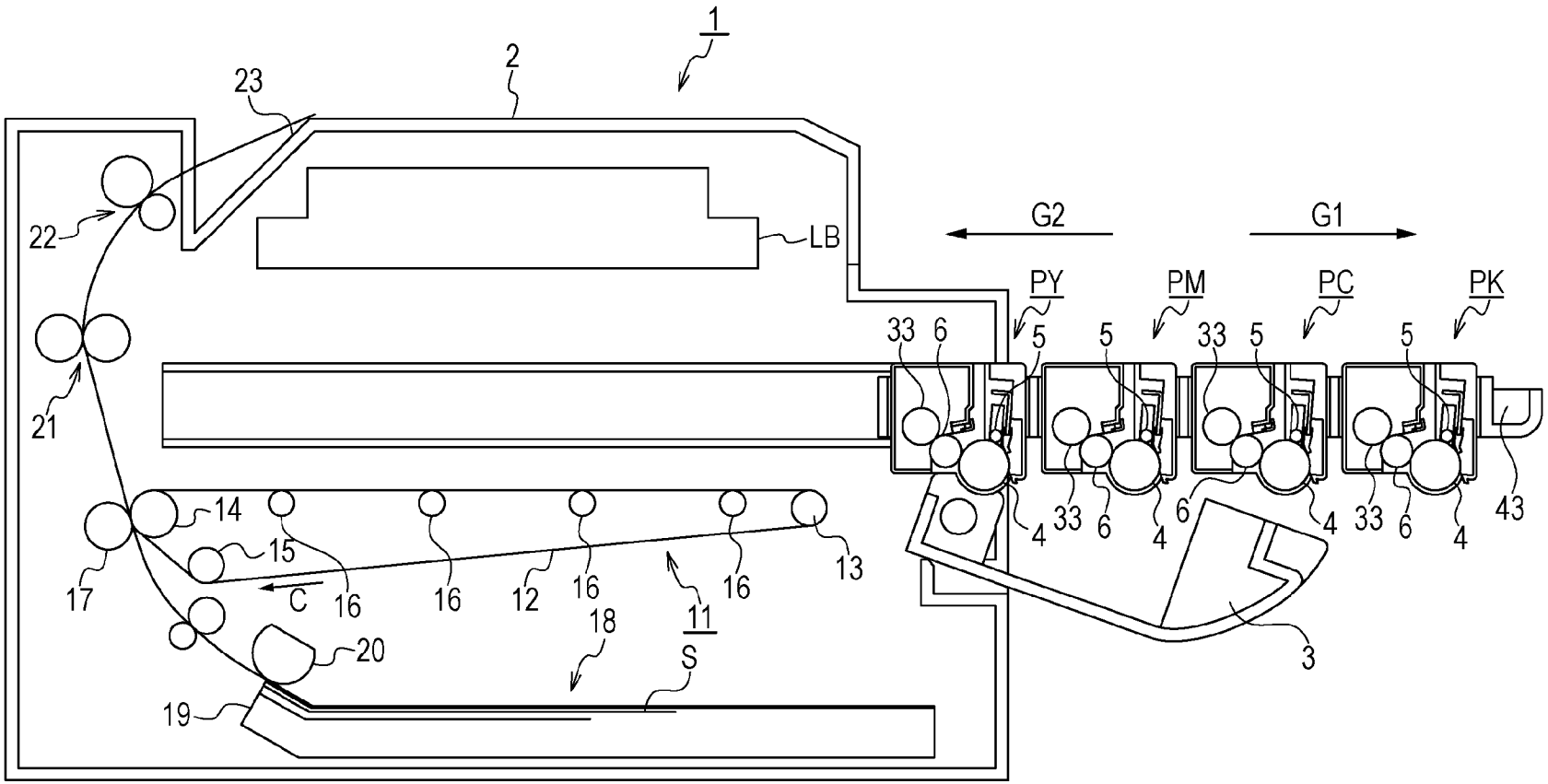
FIG. 5 is a schematic cross-sectional view illustrating a demountably mountable state of the process cartridge of this disclosure.

FIG. 5 is a schematic cross-sectional view illustrating a state in which a cartridge tray 43 is drawn out from the main body 2 of the apparatus and hence the cartridges (PY, PM, PC, and PK) are free to be mounted and demounted.

Figure 6:
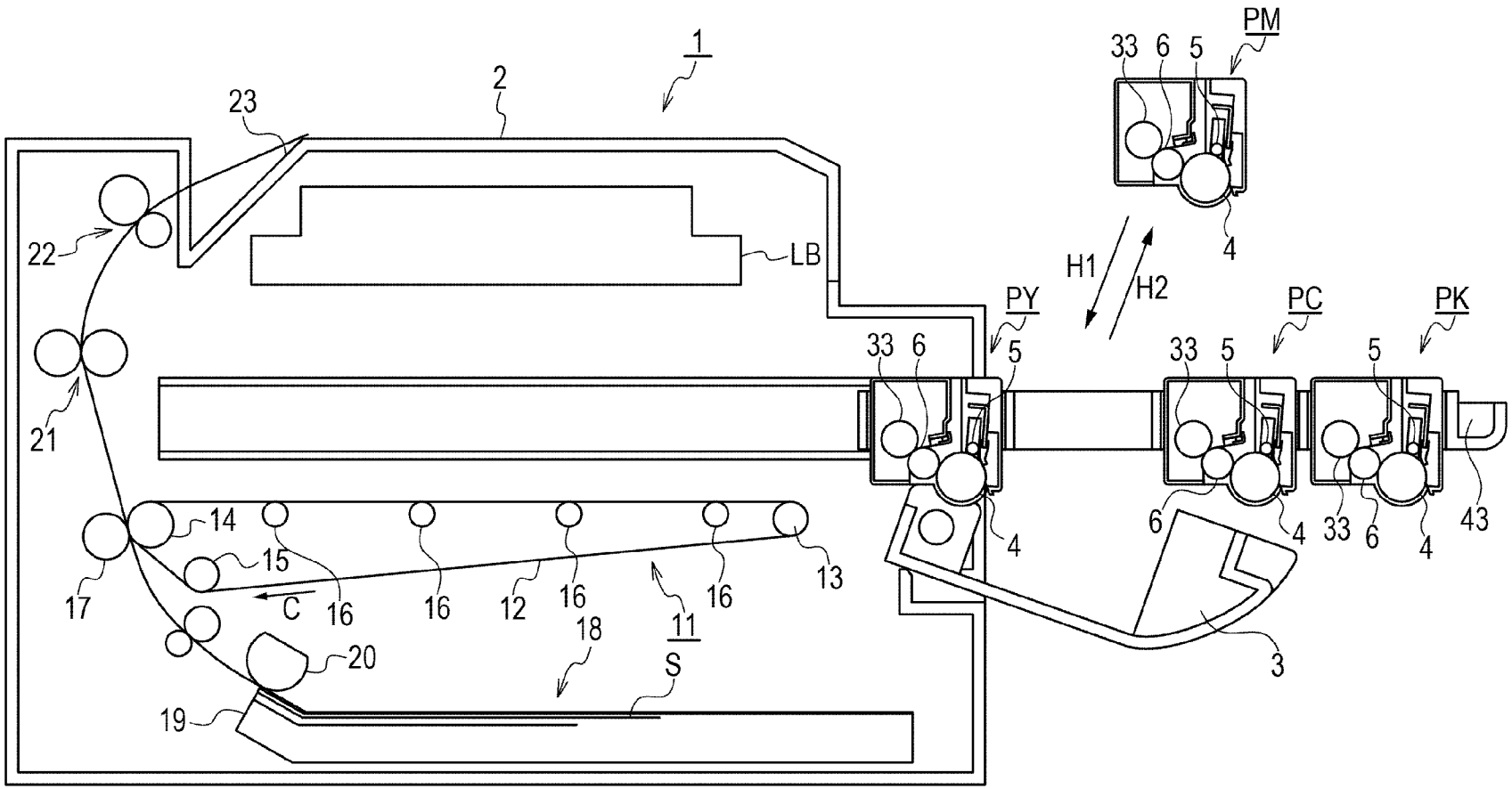
FIG. 6 is a schematic cross-sectional view illustrating an example of a demounting and mounting operation of the process cartridge of this disclosure.

FIG. 6 is a schematic cross-sectional view illustrating mounting and demounting operations of the cartridges P (PY, PM, PC, and PK) with respect to the cartridge tray 43.

The cartridge tray 43 which allows mounting and demounting of the cartridges P (PY, PM, PC, and PK) is provided in the main body 2 of the apparatus.

The cartridge tray 43 is configured to allow a linear movement (push in and drawn out) in directions G1 and G2, which substantially correspond to the horizontal direction with respect to the main body 2 of the apparatus as illustrated in FIG. 5. Then, the cartridge tray 43 may take a mounting position in the main body 2 of the apparatus and a drawn-out position which is a position taken when the cartridge tray 43 is drawn out from the mounting position.

First of all, the mounting operation of the cartridges P (PY, PM, PC, and PK) to the main body 2 of the apparatus will be described. As illustrated in FIG. 5, the apparatus opening-and-closing door 3 is opened, and the cartridge tray 43 is moved in the direction indicated by an arrow G1, whereby the cartridge tray 43 is moved to the drawn-out position. In this state, the cartridges P may be mounted from the direction indicated by an arrow H1 to the cartridge tray 43 and are held as illustrated in FIG. 6. The cartridge tray 43 on which the cartridges P (PY, PM, PC, and PK) are held is moved in the direction indicated by an arrow G2 in FIG. 5, and the cartridge tray 43 is moved to the mounting position in the main body 2 of the apparatus. Then, by closing the apparatus opening-and-closing door 3, the mounting operation of the cartridges P (PY, PM, PC, and PK) to the main body 2 of the apparatus is completed (FIG. 2).

In contrast, taking out of the cartridges P (PY, PM, PC, and PK) from the main body 2 of the apparatus will be described. As illustrated in FIG. 5, in the same manner as the mounting operation of the cartridges P (PY, PM, PC, and PK) described above to the main body 2 of the apparatus, the cartridge tray 43 is moved to the drawn out position. In this state, the cartridges P are taken out in the direction indicated by an arrow H2 in FIG. 6, and the taking-out operation of the cartridges P (PY, PM, PC, and PK) from the main body 2 of the apparatus is completed.

The cartridges P are configured to be demountably mountable with respect to the main body 2 of the apparatus by the operation as described above.

Configuration of Developing Apparatus

Figure 7:
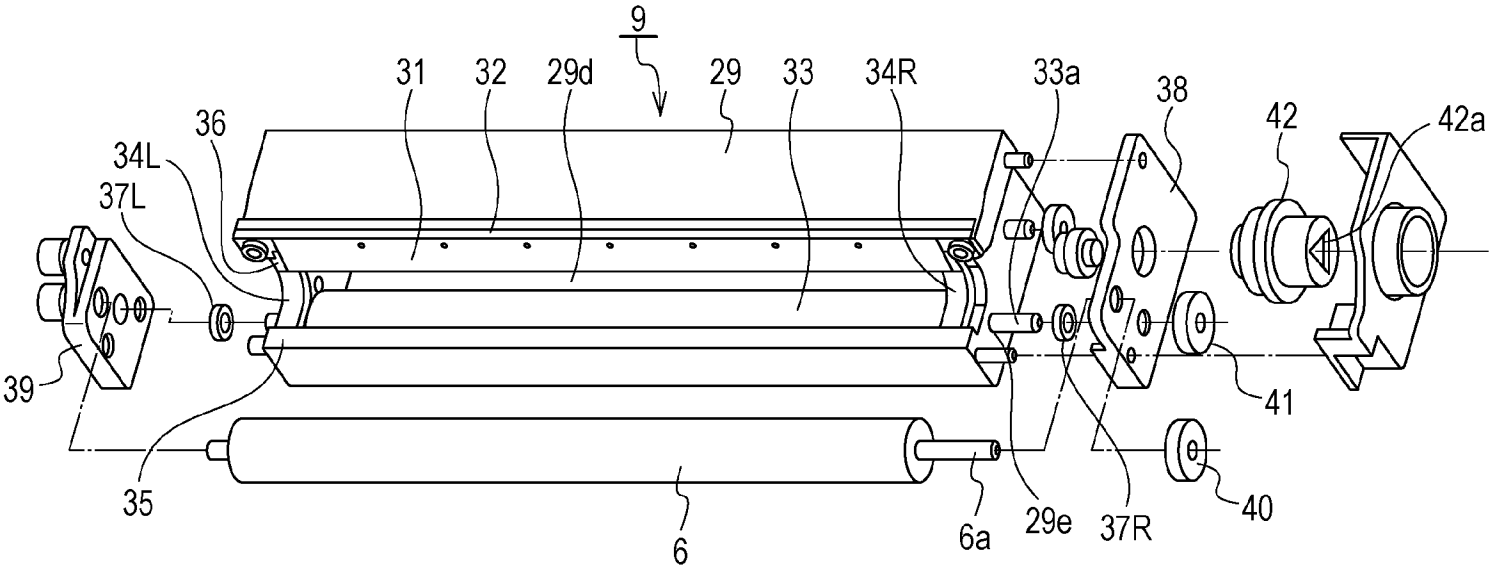
FIG. 7 is an exploded perspective view illustrating an example of a developing apparatus of this disclosure.

FIG. 7 is an exploded perspective view illustrating an example of the developing apparatus according to this disclosure.

As illustrated in FIG. 7, the developing apparatus (developing cartridge) 9 has a laterally elongated shape extending so that the longitudinal direction thereof is oriented in the direction of axis of rotation of the developing roller (developer bearing member) 6, which corresponds to the developing device (hereinafter, the direction of the axis of rotation of the developing roller 6 is referred to as "longitudinal direction"). The developing apparatus 9 includes the developing frame 29, a developing blade 31, a toner supply roller (developer supply member) 33, a development end portion sealing members 34R and 34L, a flexible sheet member 35, and supply roller shaft seals 37R and 37L in addition to the developing roller 6.

The developing roller (developer bearing member) 6, bearing the toner discharged from the developing frame 29 (FIG. 3), is arranged so as to include an entire area of the aperture portion 29*d* in the longitudinal direction. The toner supply roller 33 is arranged so as to intrude into the developing roller 6 in the radial direction (FIG. 3).

As illustrated in FIG. 7, both end portions of the core materials of the developing roller 6 and the toner supply roller 33 are rotatably supported by a drive-side bearing (bearing member) 38 and a nondrive-side bearing (bearing member) 39 mounted on both side surfaces of the developing frame 29, respectively.

A developing roller gear 40 and a toner supply roller gear 41 are arranged at end portions on the drive side of a core material 6*a* of the developing roller 6 and a core material 33*a* of the toner supply roller 33 respectively, and engage a development drive input gear 42. The development drive input gear 42 is provided with a development drive coupling 42*a* which a drive output coupling (not illustrated) of the main body 2 of an apparatus engages to transmit a drive force of a drive motor (not illustrated) of the main body 2 of the apparatus, and the developing roller 6 and the toner supply roller 33 are driven to rotate at a predetermined speed.

The developing blade 31 is a resilient metal thin plate having a thickness on the order of 0.1 mm, and a free end of the developing blade 31 in the short direction comes into abutment with the developing roller 6 in a direction opposite to the direction of rotation of the developing roller 6 (the direction indicated by the arrow E in FIG. 3). As illustrated in FIG. 3, an under development blade sealing member 36 is arranged so as to infill a gap between the developing frame 29 and a developing blade unit 30 over the entire area in the longitudinal direction and prevents toner leakage.

As illustrated in FIG. 7, the development end portion sealing members 34R and 34L are arranged at both ends of an aperture portion 29*d* of the developing frame 29, and prevents the toner leakage from a gap between the developing blade 31 and the developing roller 6, and the developing frame 29.

The flexible sheet member 35 is formed of a plastic film, for example, polyethylene terephthalate, or polyphenylene sulfide, and has a thickness on the order of 50 μm. The flexible sheet member 35 is arranged so as to come into abutment with the developing roller 6 along the longitudinal direction on the side opposing the developing blade 31 at the aperture portion 29*d* of the developing frame 29, and prevents the toner leakage from a gap between the developing frame 29 and the developing roller 6.

The toner supply roller shaft seals 37R and 37L are mounted on a portion of the toner supply roller core material 33*a* of the toner supply roller 33 exposed to the outside of the developing frame 29 to prevent the toner leakage from a gap between a core through hole 29*e* provided on the developing frame 29 and the toner supply roller core material 33*a*.

The developing apparatus 9 is always urged by a compression spring (not illustrated) in a direction in which the developing roller 6 comes into contact with the photosensitive drum 4 (a direction indicated by an arrow W in FIG. 3) about a center of pivotal movement (axis b) illustrated in FIG. 3 and FIG. 4. When forming an image, the developing roller 6 is in abutment with the photosensitive drum 4, and when not forming an image, the developing roller 6 moves away from the photosensitive drum 4 against an urging force of the compression spring described above by a separating device, not illustrated. The developing roller 6 repeats the operation of the developing apparatus between the abutting position and the separating position depending on whether an image is to be formed or not.

When forming the image, the developing roller 6 bears the toner in the developing frame 29 thereon by friction between the toner supply roller 33 and the developing roller 6 by being driven to rotate. The developing blade 31 restricts the thickness of a toner layer formed on a peripheral surface of the developing roller 6, and provides the toner with electric charge by a triboelectric charging by an abutment pressure between the developing blade 31 and the developing roller 6.

Then, the charged toner on the developing roller 6 at a contact portion between the developing roller 6 and the photosensitive drum 4 is adhered on an electrostatic latent image on the photosensitive drum 4, whereby a latent image is developed.

Configuration of Fixation between Development Frame Member and Nondrive-side Bearing (Bearing Member)

Referring now to FIGS. 1A and 1B, FIGS. 8A to 8C, FIG. 9, and FIGS. 10A and 10B, a configuration of fixation of the nondrive-side bearing 39 to the developing frame 29 will be described. Here, the developing frame 29 corresponds to one of a first member and a second member, and the nondrive-side bearing corresponds to the other one of those. As a matter of course, this configuration of fixation may be applied to members other than the developing frame and the nondrive-side bearing.

Figure 1A:
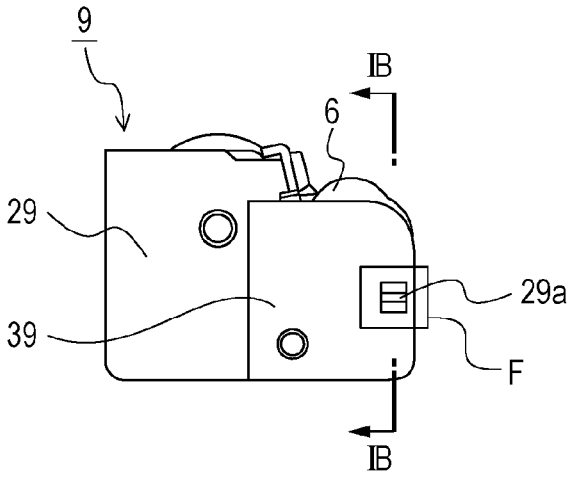
FIGS. 1A to 1D are schematic drawings illustrating an example of a configuration of fixation of components of this disclosure.
Figure 1B:
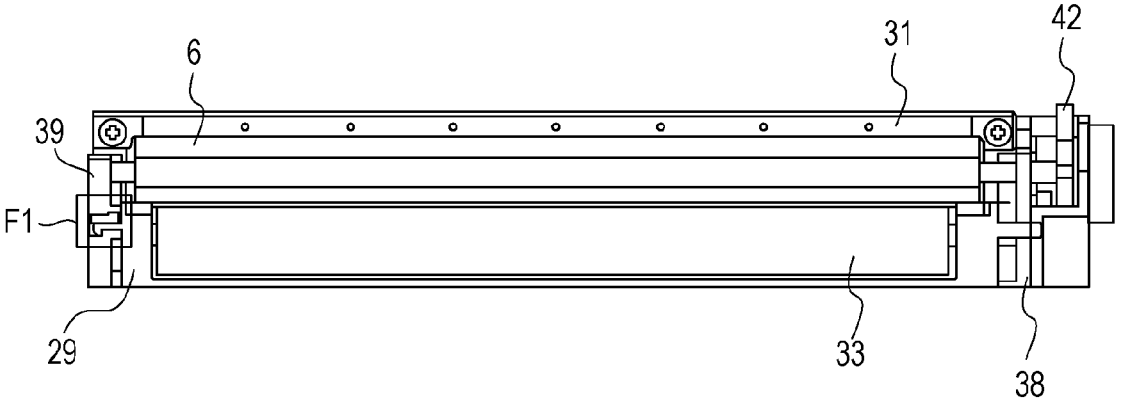
Figure 1C:
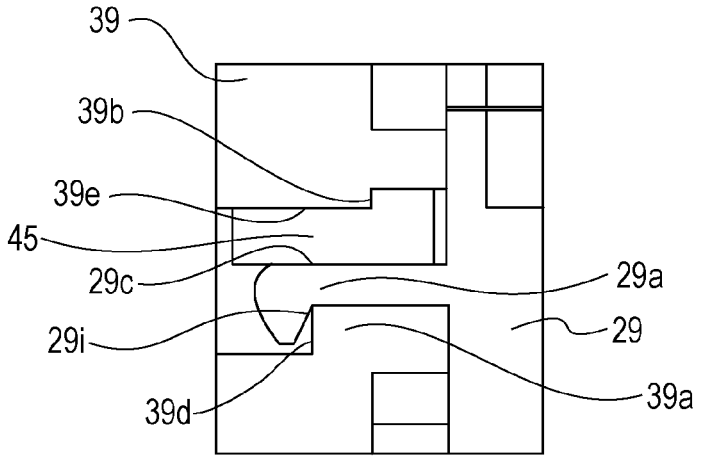
Figure 1D:
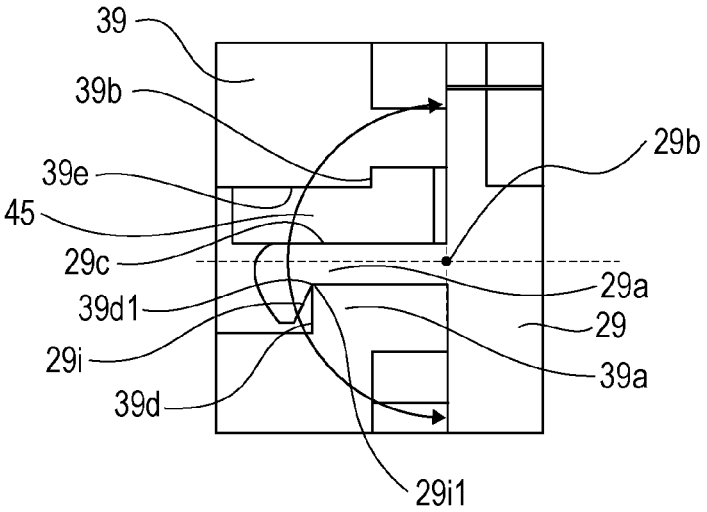

FIG. 1A illustrates the developing apparatus 9 viewed from the longitudinal direction. FIG. 1B is a cross section of the developing apparatus 9 illustrated in FIG. 1A taken along a cross section IIB-IIB passing through the developing frame 29 and a fixing portion F of the nondrive-side bearing 39, and FIG. 1C is a detailed drawing of the fixing portion F1 between the developing frame 29 and the nondrive-side bearing 39 of the cross-sectional view illustrated in FIG. 1B. FIG. 1D is a drawing illustrating a trajectory of flexible movement of a base point of movement 29*g* and a flexible portion 29*b* as a base point of the movement.

As illustrated in FIG. 1D, the developing frame 29 includes a flexible engaging portion 29*a* and engages an engaged portion 39*a* of the nondrive-side bearing 39. In FIG. 1D, a bent portion 29*i*1 of the engaging portion 29*a* and an edge portion 39*d*1 of the engaged portion 39*a* are in abutment and engagement. In order to maintain the engaging state, a third member 45 configured to restrict the movement of the flexible engaging portion 29*a* is provided.

The flexible engaging portion 29*a* is movable by bending, and the base point of the movement corresponds to the base point of movement 29*b*. As understood from FIG. 1D, a width (V1) of a tip of the third member closer to the base point of movement 29*b* is longer than a width (V2) of a tip farther from the base point of movement 29*b*.

Here, since the third member is required only to be capable of maintaining the engaging state, the third member may partly have a portion gradually decreasing in width in a tapered shape (tapered portion), or may have a protruding portion 45*a* not at an end portion but at a midsection of the third member and the width (V1) of the protruding portion is larger than the width (V2) of other portions of the third member. In this case, the protruding portion corresponds to a holding portion for holding the third member at a position for restricting the movement of the flexible engaging portion 29*a* (in FIG. 12).

Figure 8A:
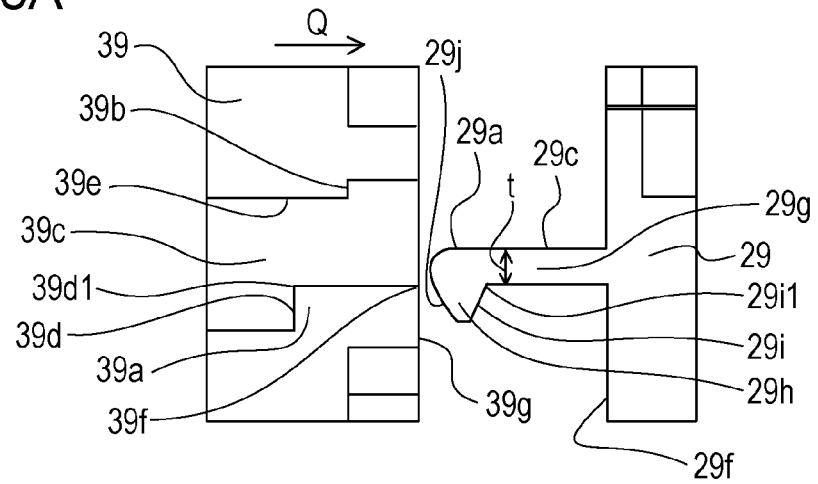
FIGS. 8A to 8C are cross-sectional views illustrating an example of a component mounting configuration of this disclosure.
Figure 8B:
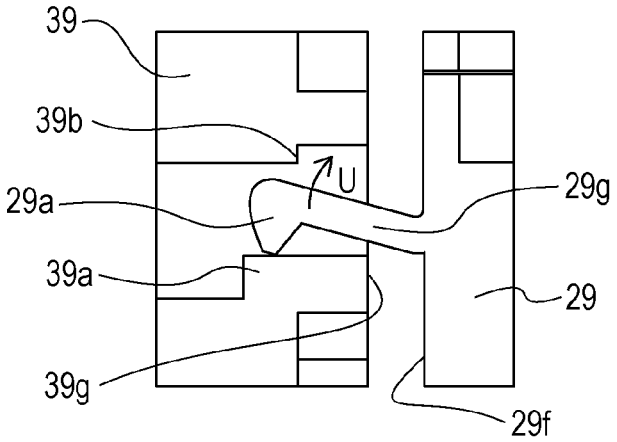
Figure 8C:
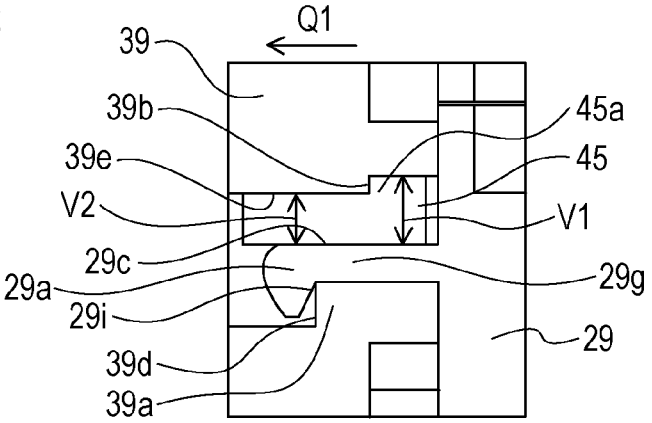

FIGS. 8A to 8C are drawings illustrating a process of mounting of the nondrive-side bearing 39 to the developing frame 29.

Figure 10A:
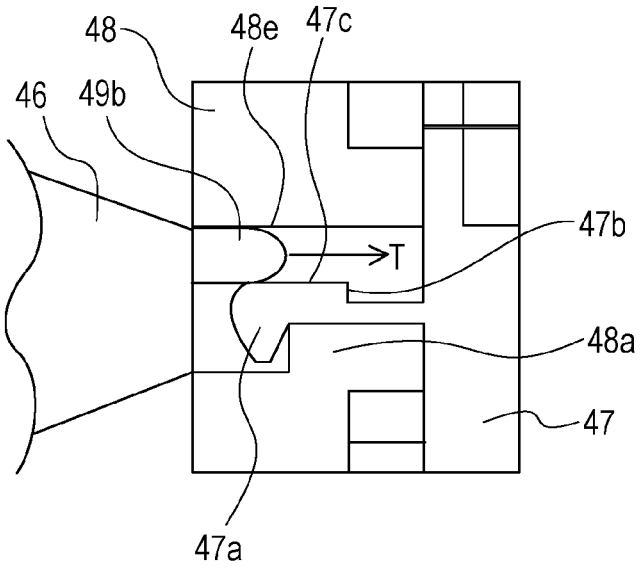
FIGS. 10A and 10B are cross-sectional views illustrating an example of a configuration of fixation of components of this disclosure.
Figure 10B:
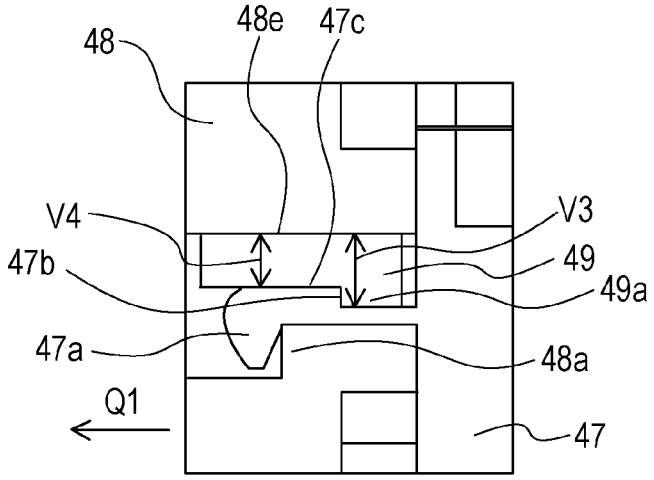

FIGS. 10A and 10B illustrate an example of a configuration of mounting and then fixing the nondrive-side bearing 39 to the developing frame 29.

As illustrated in FIGS. 8A to 8C, the developing frame 29 has the flexible engaging portion 29*a*. The engaging portion 29*a* projects outward in the longitudinal direction from a surface 29*f* of the developing frame 29 opposing the nondrive-side bearing 39. The engaging portion 29*a* includes the flexible portion 29*g* having a rectangular cross section a dimension t of which is approximately 1.2 mm, and a dimension in the direction orthogonal to a t-direction in the longitudinal direction is approximately 3.6 mm as illustrated in FIG. 8A. The flexible portion 29*g* includes a surface 29*c* on the downstream portion in the bending direction of the engaging portion 29*a* when being engaged with the engaged portion 39*a*, described later (hereinafter, referred to as "opposite surface"). An engaging extremity 29*h* having an engaging surface 29*i* is formed on the flexible portion 29*g* at a distal end side thereof in the longitudinal direction. The engaging surface 29*i* here includes the bent portion 29*i*1, which corresponds to a boundary with respect to the flexible portion 29*g*.

Figure 9:
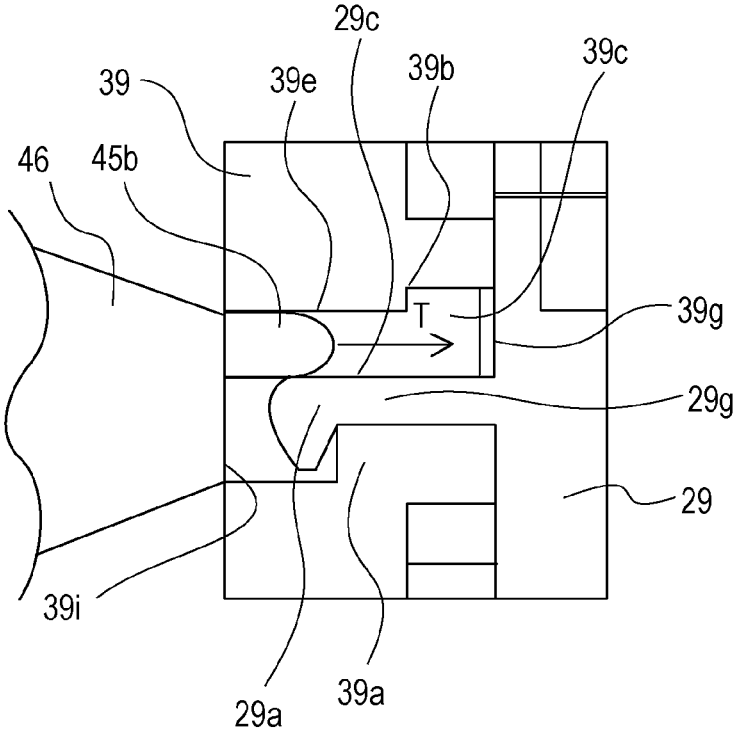
FIG. 9 is a cross-sectional view illustrating an example of molding of an embedding member of this disclosure.

The nondrive-side bearing 39 includes the engaged portion 39*a* configured to engage the engaging portion 29*a*. The engaged portion 39*a* is formed in a hole portion 39*c* of the nondrive-side bearing 39, which allows insertion of the engaging portion 29*a* provided in the direction of the axis of rotation of the developing roller 6. The engaged portion 39*a* includes an engaged surface 39*d* coming into abutment and engagement with the engaging surface 29*i* of the engaging portion 29*a*. Here, the engaged surface 39*d* includes the edge portion 39*d*1 on the side of the flexible portion 29*g*. The hole portion 39*c* includes a retaining surface 39*b* for retaining the embedding member 45, described later. The retaining surface 39*b* is composed of a depressed-shaped portion formed on an opposing surface 39*e* opposing the opposite surface 29*c* of the engaging portion 29*a* on the downstream portion of the direction indicated by an arrow Q in FIG. 8A in a direction orthogonal to the direction indicated by the arrow Q. Here, the distance V between the opposing surface 39*e* and the opposite surface 29*c* of the engaging portion is expressed by an expression V1>V2, where V1 is a distance of the depressed-shaped portion and V2 is a distance on the upstream side of the depressed-shaped portion in the direction indicated by the arrow Q as illustrated in FIG. 8C. The fusing resin 45*b* is filled in this space as illustrated in FIG. 9, then is injected to a position satisfying the expression V1>V2 as illustrated in FIG. 8C, and then is cooled and hardened to form the embedding member 45.

Mounting of the engaging portion 29*a* and the engaged portion 39*a* are achieved by mounting the nondrive-side bearing 39 to the developing frame 29 in the direction indicated by the arrow Q as illustrated in FIG. 8A. At this time, an edge 39*f* of the hole portion 39*c* on the side of the developing frame 29 comes into abutment with an inclined surface 29*j* of the engaging extremity 29*h* of the engaging portion 29*a*, whereby the flexible portion 29*g* of the engaging portion 29*a* bends in the direction indicated by an arrow U in FIG. 8B. Then, the nondrive-side bearing 39 is mounted to a position where a developing frame side end surface 39*g* comes into contact with the surface 29*f* of the developing frame 29 in the direction indicated by the arrow Q. At this time, the engaging surface 29*i* of the engaging portion 29*a* and the first engaged surface 39*d* of the engaged portion 39*a* engage as illustrated in FIG. 8C. Here, the flexible portion 29*g* may either be in a state not bent as illustrated in FIG. 8A or in engagement in a state of being bent in the direction indicated by the arrow U.

Subsequently, a configuration in which the nondrive-side bearing 39 cannot come apart from the developing frame 29 in the direction indicated by an arrow Q1 in FIG. 8C after the engagement between the engaging portion 29*a* and the engaged portion 39*a* described above.

As illustrated in FIG. 8C, by restricting the engaging portion 29*a* from bending in the direction indicated by the arrow U after the engagement between the engaging portion 29*a* and the engaged portion 39*a*, the state of engagement between the engaging portion 29*a* and the engaged portion 39*a* may be maintained. Accordingly, the embedding member 45, which corresponds to the third member configured to restrict the engaging portion 29*a* from being bent in the direction indicated by the arrow U while keeping in contact with two surfaces, that is, the opposite surface 29*c* and the opposing surface 39*e* opposing thereto and fix the developing frame 29 and the nondrive-side bearing 39, is provided. The opposing surface 39*e* may be formed on the developing frame 29 or any other components in addition to the nondrive-side bearing 39. Accordingly, bending of the engaging portion 29*a* may be restricted, and the developing frame 29 having the engaging portion 29*a* and the nondrive-side bearing 39 having the engaged portion 39*a* may be fixed.

At this time, the embedding member 45 is formed by an injection unit having an injection gate 46 (not illustrated) as illustrated in FIG. 9. The embedding member 45 (FIG. 8C) is formed by bringing the engaging portion 29*a* of the developing frame 29 and the engaged portion 39*a* of the nondrive-side bearing 39 into engagement, then injecting the fusing resin 45*b* fused at a high temperature into the hole portion 39*c* of the nondrive-side bearing 39 with the injection gate 46 brought into abutment against the opposite surface 39*i* opposite to the developing frame body side end surface 39*g* so as to extend along the same as illustrated in FIG. 9, and injecting the fusing resin 45*b* fused at a high temperature. Here, the fusing resin 45*b* flows from the injection gate 46 in a direction indicated by an arrow T along the opposite surface 29*c* and the opposing surface 39*e* and then flows while keeping in contact with the retaining surface 39*b* to the downstream of the retaining surface 39*b* in the direction indicated by the arrow T as illustrated in FIG. 8C. In this manner, by filling the fusing resin, the embedding member 45 having the embedding member retaining portion 45*a* of a protruding shape (protruding portion) corresponding to the depressed portion is formed. Therefore, even though the dimensions between the opposite surface 29*c* and the opposing surface 39*e* vary due to the tolerances, the embedding member 45 is formed in a state of being in tight contact with each of the opposite surface 29*c* of the developing frame 29 and the opposing surface 39*e* of the nondrive-side bearing 39, and the engaging portion 29*a* does not bend in the direction indicated by the arrow U as illustrated in FIG. 8B. Accordingly, the developing frame 29 and the nondrive-side bearing 39 having the engaging portion 29*a* and the engaged portion 39*a* respectively are fixed in the direction indicated by the arrow Q1. Through this process, the cartridge is manufactured. When manufacturing the cartridge, components such as memory may be mounted after the manufacturing process of this embodiment has performed, or may be mounted before the manufacturing process of this embodiment.

With contact between the retaining surface 39*b* of the nondrive-side bearing 39 and the embedding member retaining portion 45*a* in the direction indicated by the arrow Q1 in FIG. 8C, the embedding member 45 is prevented from coming apart in the direction indicated by the arrow Q1.

As another example of the embedding member, the engaging portion of the developing frame, the engaged portion of the nondrive-side bearing, and the embedding member are formed of the same resin. Accordingly, the surfaces of the engaging portion and the engaged portion, which are formed of the same resin, are fused by heat of the fused resin when injection-molding the fusing resin which constitutes the embedding member and are solidified later, thereby being combined each other. As a matter of course, there are a case where a resin which is the same as that of the development frame but different from that of the nondrive-side bearing is used for the embedding member and a case where a resin which is different from that of the developing frame but the same as that of the nondrive-side bearing is used depending on the application.

In this embodiment, the engaging portion 29*a* of the developing frame 29 and the engaged portion 39*a* of the nondrive-side bearing 39 are formed, for example, of polystyrene, and the embedding member 45 is formed of a different resin, for example, conductive polyacetal. In this manner, even with materials different from each other and having no compatibility, the embedding member 45 can be fixed by providing the retaining portion 39*b* for retention of the embedding member 45. In addition, if the material of the embedding member has electrical conductivity, the embedding member can be used as an electric contact by forming in contact with a contact route.

Although the embedding member is formed by injection-molding, this disclosure is not limited thereto. For example, a configuration in which the engaging portion 29*a* does not bend is achieved by press-fitting a resilient member such as rubber slightly larger than a space between the opposite surface 29*c* and the opposing surface 39*e* opposing thereto illustrated in FIG. 8C into the corresponding space.

As described above, according to this disclosure, fixation of the nondrive-side bearing 39 to the developing frame 29 is achieved without rattling by the engagement between the engaging portion 29*a* and the engaged portion 39*a* thereof, and configuring the embedding member which resists from coming apart from the engaging portion.

Although the developing frame 29 has the engaging portion 29*a* and the nondrive-side bearing 39 has the engaged portion 39*a* in this disclosure, a configuration in which the nondrive-side bearing 39 has an engaging portion and the developing frame 29 has an engaged portion is also applicable. Also, although the configuration of fixation between the developing frame 29 and the nondrive-side bearing 39 has been described in this disclosure, this disclosure is not limited thereto. For example, the same advantages are achieved also in a case of fixing components, at least one of which is formed of a flexible resin, without rattling such as fixation of the cleaner case 26 with the drive-side cover member 24 or with the nondrive-side cover member 25. Accordingly, the relative position of the process devices requiring positional accuracy such as between the developing roller 6 and the developing blade 31 or between the photosensitive drum 4 and the cleaning blade 7 can be fixed easily with high degree of accuracy.

Example 2

Configuration of Retention with Embedding Member for Fixation between Development Frame Member and Nondrive-side Bearing Referring now to FIG. 10 and FIG. 11, another form of this disclosure will be described as Example 2. In Example 1, the embedding member 45 is prevented from coming apart by bringing the retaining portion 45*a* of the embedding member 45 formed between the opposite surface 29*c* and the opposing surface 39*e* into contact with the retaining surface 39*b* of the nondrive-side bearing 39. In Example 2, a configuration of retention with an embedding member in another form will be described. Therefore, description overlapping with that of Example 1 will be omitted.

FIGS. 10A and 10B are detailed drawing illustrating a fixing portion between a developing frame 47 and a nondrive-side bearing 48. First of all, an engaging portion 47*a* provided on the developing frame 47 and an engaged portion 48*d* provided on the nondrive-side bearing 48 are engaged in the same configuration as the engagement between the engaging portion 29*a* and the engaged portion 39*a* illustrated in FIGS. 8A to 8D of Example 1. Subsequently, in the same manner as forming the embedding member 45 by injecting the fusing resin 45*b* from the injection gate 46 illustrated in FIG. 9, an embedding member 49 is formed by injecting a fusing resin 49*b* fused at a high temperature as illustrated in FIG. 10A. Here, the fusing resin 49*b* is formed in a direction indicated by an arrow T from the injection gate 46 along an inclined surface 47*c* and an opposing surface 48*e* of the engaging portion. A retaining surface 47*b* is formed by a depressed-shaped portion formed on the inclined surface 47*c* of the engaging portion 47*a* in a direction orthogonal to a direction of an arrow Q1 on the upstream side of the direction indicated by the arrow Q1 in FIG. 10B. Here, a distance V between the opposing surface 48*e* and the opposite surface 47*c* of the engaging portion is expressed by an expression V3>V4, where V3 is a distance of the depressed-shaped portion and V4 is a distance on the downstream side of the depressed shaped portion in the direction indicated by the arrow Q1 as illustrated in FIG. 10B. Accordingly, the fusing resin 49*b* is injected to a position satisfying the expression V3>V4 as illustrated in FIG. 10B, and then the embedding member 49 is formed.

Even though the dimensions between the opposite surface 47*c* and the opposing surface 48*e* of the engaging portion vary due to the tolerances, the embedding member 49 is formed in a state of being in tight contact with the opposite surface 47*c* of the engaging portion of the developing frame 47 and the opposing surface 48*e* of the nondrive-side bearing 48 is fixed.

With contact between the retaining surface 47*b* of the developing frame 47 and an embedding member retaining portion 49*a* in the direction indicated by the arrow Q1 in FIG. 10B, the embedding member 45 is prevented from coming apart in the direction indicated by the arrow Q1.

Figure 11A:
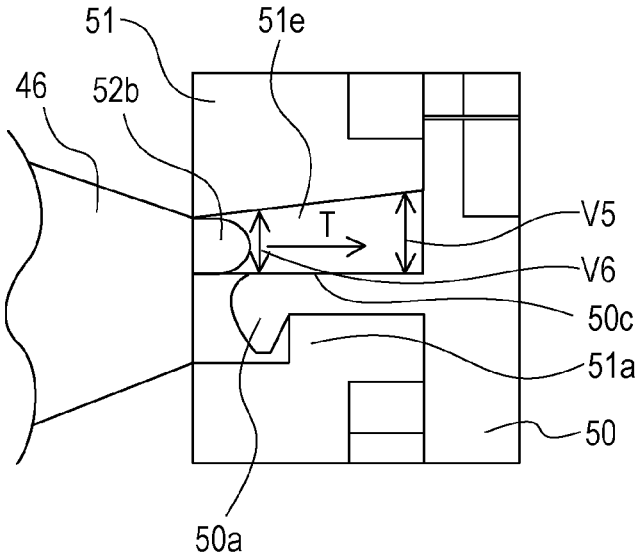
FIGS. 11A and 11B are cross-sectional views illustrating an example of a configuration of fixation of components of this disclosure.
Figure 11B:
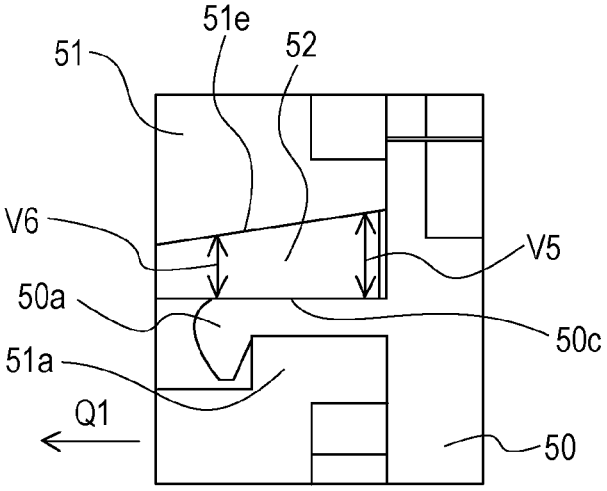

Furthermore, as another example, a detailed drawing of a fixing portion between a developing frame 50 and a nondrive-side bearing 51 is illustrated in FIGS. 11A and 11B. In the same manner as the engagement between the developing frame 47 and the nondrive-side bearing 48 described above, an engaging portion 50*a* provided on the developing frame 50 and an engaged portion 51*d* provided on the nondrive-side bearing 51 are engaged. Subsequently, an embedding member 52 is formed by injecting a fusing resin 52*b* fused at a high temperature as illustrated in FIG. 11A. Here, the fusing resin 52*b* is formed in a direction indicated by the arrow T from the injection gate 46 along an opposite surface 50C and an opposing surface 51*e* of the engaging portion. Here, the opposing surface 51*e* of the nondrive-side bearing 51 is formed into the opposing surface 51*e* having a tapered shape (tapered portion) so that a root distance V5 and a tip distance V6 of the engaging portion 50*a* satisfy an expression V5>V6 in the distance V with respect to the opposite surface 50*c* of the engaging portion, and the fusing resin 52*b* is injected to a position where the expression V5>V6 is satisfied as illustrated in FIG. 11B to form the embedding member 52 having a tapered shape (tapered portion) corresponding to the tapered shape on the nondrive-side bearing side. Even though the dimensions between the opposite surface 50*c* and the opposing surface 51*e* of the engaging portion vary due to the tolerances, the embedding member 52 is formed in a state of being in tight contact with the opposite surface 50*c* of the developing frame 50 and the opposing surface 51*e* of the nondrive-side bearing 51, and is fixed in a state in which the engagement is maintained.

Also by contact between the embedding member 52 with the opposing surface 51*e* of the nondrive-side bearing 51 formed into a tapered shape (tapered portion) with respect to the opposite surface 50*c* of the engaging portion, the embedding member 52 is prevented from coming apart in the direction indicated by the arrow Q1 in FIG. 11B.

Figure 12:
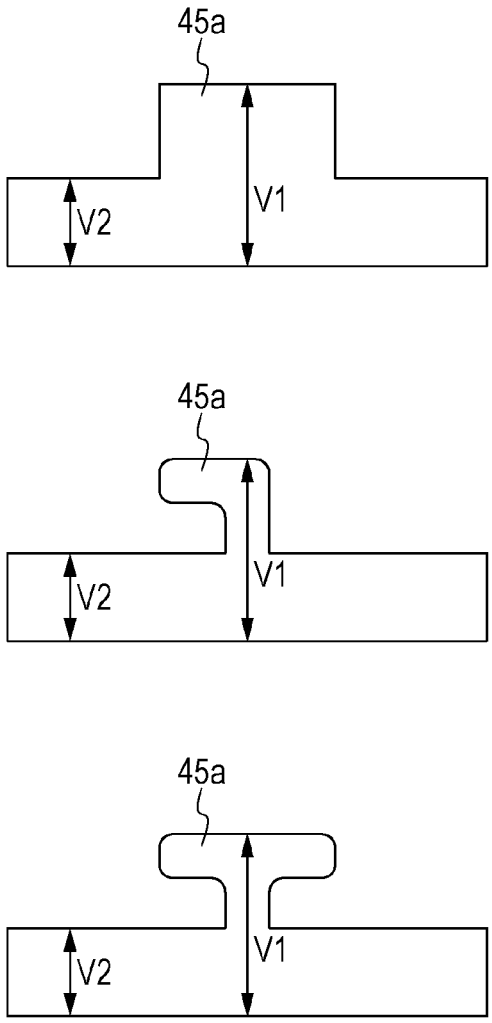
FIG. 12 is a cross-sectional view illustrating an example of a third member of this disclosure.

As illustrated in FIG. 12, a configuration in which the retaining portion (holding portion) 45*a* is in a midsection of the third member. The holding portion is formed with a protruding portion corresponding to the depressed portion (held portion) by the fused resin flowed into the depressed portion (held portion) of the first member or the second member. Accordingly, holding portions such as a protruding portion having one claw-shaped claw portion or a protruding portion having two claw portions as illustrated in FIG. 12 may be formed. In a case where the fusing resin is used, the holding portion and the held portion may be manufactured by being further tightly engaged with each other.

As described above, with the configuration as described in Example 2 in addition to Example 1, fixation of the nondrive-side bearing to the developing frame is achieved without rattling by the engagement between the engaging portion and the engaged portion thereof, and configuring the embedding member which resists from coming apart from the engaging portion.

As described above, according to this disclosure, the cartridge with reduced rattling may be provided even though the dimensions of the first member and the second member vary due to the tolerances.

In addition, a cartridge having stable positional accuracy between the members provided in the cartridge may also be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-269557, filed Dec. 10, 2012, which is hereby incorporated by reference herein in its entirety.

What is claimed is:

1. A method of manufacturing a cartridge including a first member having a flexible engaging portion and a second member having an engaged portion to engage with the flexible engaging portion, comprising:

attaching the first member to the second member in a first direction, and engaging a hook, provided on the flexible engaging portion so as to protrude to a second direction crossing with the first direction, to the engaged portion; and forming a third member configured to restrict a movement of the flexible engaging portion so as to sequentially arrange the first member, the third member and the second member in a third direction opposite the second direction by flowing a fusing resin in between the first member and the second member and solidifying the fusing resin.

2. The method of manufacturing a cartridge according to claim 1, wherein the third member is formed so a width of the third member on a side closer to a base point of movement of the flexible engaging portion becomes larger than a width of the third member on a side farther from the base point of movement.

3. The method of manufacturing a cartridge according to claim 1, wherein forming the third member includes forming the third member having a holding portion configured to hold the third member at a position that restricts the movement of the flexible engagement portion.

4. The method of manufacturing a cartridge according to claim 1, wherein forming the third member includes forming the third member having a protruding portion corresponding to a depressed portion by flowing a fusing resin into the depressed portion of the first member or the second member and subsequently solidifying.

5. The method of manufacturing a cartridge according to claim 1, wherein the third member is formed of a resin, and the third member is formed by injection-molding.

6. The method of manufacturing a cartridge according to claim 1, wherein the fusing resin fuses a surface of the first member or the second member to couple the surface to the third member.

7. A cartridge comprising:

a first member having a flexible engaging portion;

a second member having an engaged portion to be engaged with the flexible engaging portion; and a third member configured to restrict a movement of the flexible engaging portion for maintaining a state in which the flexible engaging portion and the engaged portion engage each other;

wherein a width of the third member on a side closer to a base point of movement of the flexible engaging portion becomes larger than a width of the third member on a side farther from the base point of movement, wherein the third member includes a holding portion configured to hold the third member at a position capable of restricting the movement of the flexible engaging portion, and at least one of the first member and the second member includes a held portion to be engaged with the holding portion wherein the third member is formed of a resin different from the flexible engaging portion or the engaged portion.

8. The cartridge according to claim 7, wherein the first member or the second member is a bearing member configured to support a developer bearing member.

9. The cartridge according to claim 7, wherein the first member or the second member is a bearing member configured to support an image bearing member.

10. An image forming apparatus configured to form an image by using developer in a state in which the cartridge according to claim 7 is demountably mounted.

11. The cartridge according to claim 7, wherein the third member includes a tapered portion or a protruding portion.

12. The cartridge according to claim 7, wherein at least the first member or the second member includes a tapered portion corresponding to the tapered portion of the third member or a depressed portion corresponding to the protruding portion.

* * * * *